US006931664B1

(12) United States Patent
Chen

(10) Patent No.: US 6,931,664 B1
(45) Date of Patent: Aug. 23, 2005

(54) FACEMASK HARNESS

(76) Inventor: Shyan-Wei Chen, No. 17, Kung 6 Road, Linkou 2nd Industrial Park, Taipei Hsien (TW)

( * ) Notice: Subject to any disclaimer, the term of this patent is extended or adjusted under 35 U.S.C. 154(b) by 0 days.

(21) Appl. No.: 10/790,077

(22) Filed: Mar. 2, 2004

(51) Int. Cl.[7] ..... A42B 1/00
(52) U.S. Cl. ..... 2/9; 2/173; 2/425
(58) Field of Search ..... 2/452, 9, 173, 2/425, 424, 10; 128/207.11

(56) References Cited

U.S. PATENT DOCUMENTS

| | | | | | |
|---|---|---|---|---|---|
| 1,449,183 | A | * | 3/1923 | Johnstone | 2/9 |
| 1,488,812 | A | * | 4/1924 | Goodman | 2/9 |
| 2,028,462 | A | * | 1/1936 | Malcom | 2/9 |
| 4,692,002 | A | * | 9/1987 | Meistrell | 351/156 |
| 4,910,806 | A | * | 3/1990 | Baker et al. | 2/452 |
| 5,046,200 | A | * | 9/1991 | Feder | 2/452 |
| 5,184,354 | A | * | 2/1993 | Alfaro et al. | 2/425 |
| 5,267,353 | A | * | 12/1993 | Milligan | 2/9 |
| 5,542,128 | A | * | 8/1996 | Lomas | 2/173 |
| 5,662,101 | A | * | 9/1997 | Ogden et al. | 128/205.25 |
| 6,012,164 | A | * | 1/2000 | Deal, III | 2/9 |
| 6,038,706 | A | * | 3/2000 | Seiler | 2/426 |
| 2004/0025882 | A1 | * | 2/2004 | Madaus et al. | 128/206.27 |

FOREIGN PATENT DOCUMENTS

JP 08024390 A * 1/1996 ..... A63B 71/10

* cited by examiner

*Primary Examiner*—Rodney M. Lindsey
(74) *Attorney, Agent, or Firm*—Troxell Law Office, PLLC

(57) ABSTRACT

A facemask harness used in a facemask for baseball is disclosed to have the body of the facemask harness formed of an inner foam rubber layer and an outer elastic fabric layer adhered to said inner foam rubber layer, the body of the facemask harness having a top strap stitched to the top side thereof and provided with hook and loop materials for fastening and two side straps respectively stitched to the two opposite lateral sides thereof and respectively provided with hook and loop materials for fastening.

3 Claims, 9 Drawing Sheets

FACEMASK HARNESS

BACKGROUND AND SUMMARY OF THE INVENTION

The present invention relates to a facemask for baseball game and, more specifically, to a facemask harness used in a facemask for fastening the cage to the user's head which gives a comfortable wearing and, prevents slipping.

FIGS. 1~3 show a facemask constructed according to the prior art. As illustrated, the facemask is comprised of a cage 5 and a harness 6. The harness 6 comprises a plurality of adjustment straps 61;62;63 adjustably fastened to the cage 5. However, this structure of facemask is still not satisfactory in function because of the following drawbacks:

1. The harness 6 is formed of a transverse base strap 60, a number of adjustment straps 61;62;63, and supplementary straps 64. The straps 60~64 are fastened to one another by stitches. This design of harness 6 is not comfortable in use. Even if elastic material is used to make the transverse base strap 60, it is still difficult to keep the harness 6 positively in close contact with the user's head.
2. After fastening of the facemask to the user's head, the straps 60~64 may slip on the smooth surface of the user's helmet 7. In order to prevent slipping of the straps 60~64 may slip on the smooth surface of the user's helmet 7, the straps 60~64 must be fastened tight, giving an uncomfortable touch to the user.

The present invention has been accomplished under the circumstances in view. It is therefore one object of the present invention to provide a facemask harness, which gives a comfortable wearing. It is another object of the present invention to provide a facemask harness, which does not slip on the user's helmet, thereby holding the facemask positively in position. To achieve these and other objects of the present invention, the facemask harness comprises a body and a plurality of straps adapted to secure the body to the cage of the facemask. The body of the facemask harness is formed of an inner foam rubber layer and an outer elastic fabric layer adhered to the inner foam rubber layer. Further, the straps are respectively provided with hook and loop materials for detachably fastening to the cage of the facemask.

DETAILED DESCRIPTION OF THE INVENTION

Figure 1:
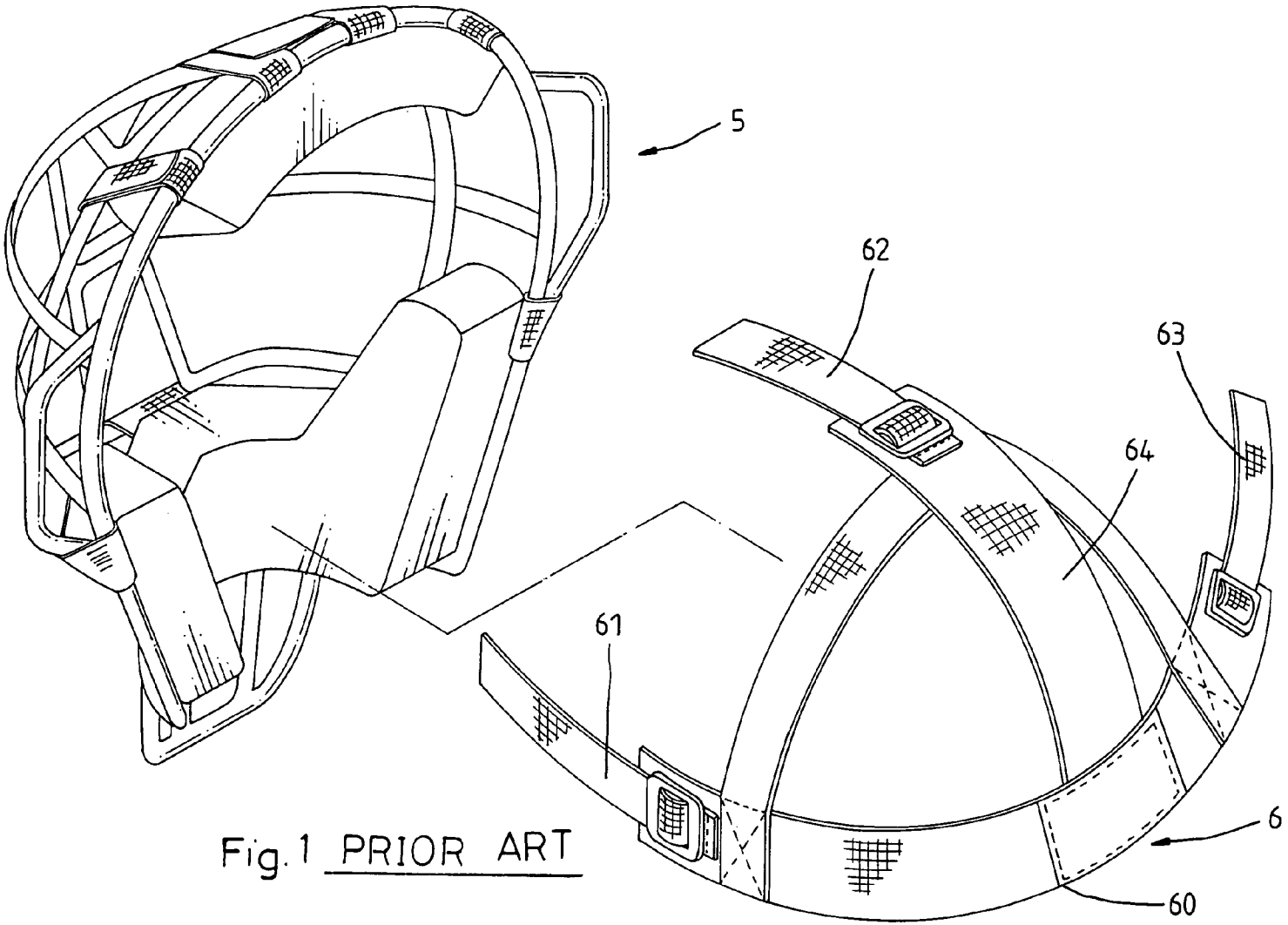
Fig. 1 PRIOR ART
FIG. 1 is an exploded view of a facemask for baseball game according to the prior art.
Figure 2:
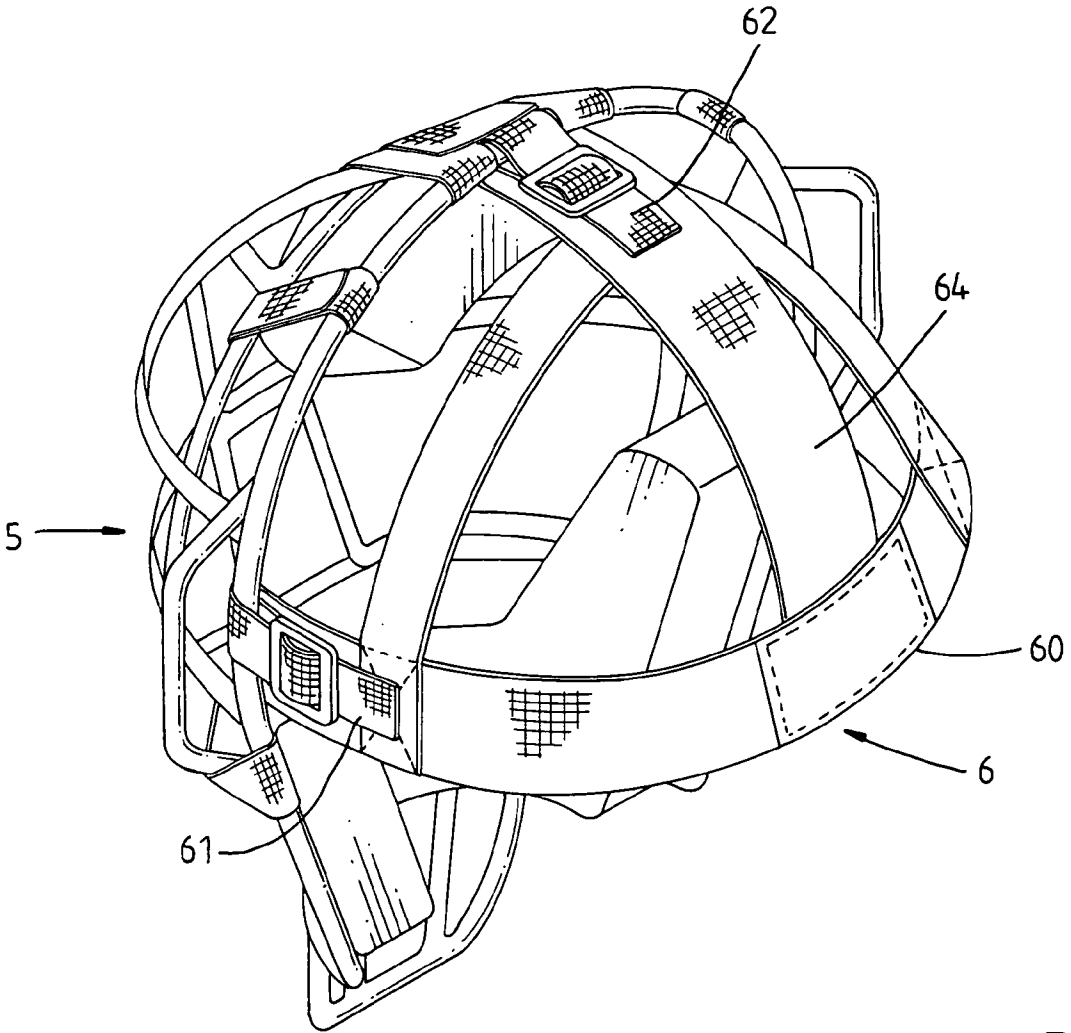
Fig. 2 PRIOR ART
FIG. 2 is a perspective assembly view of the facemask shown in FIG. 1.
Figure 3:
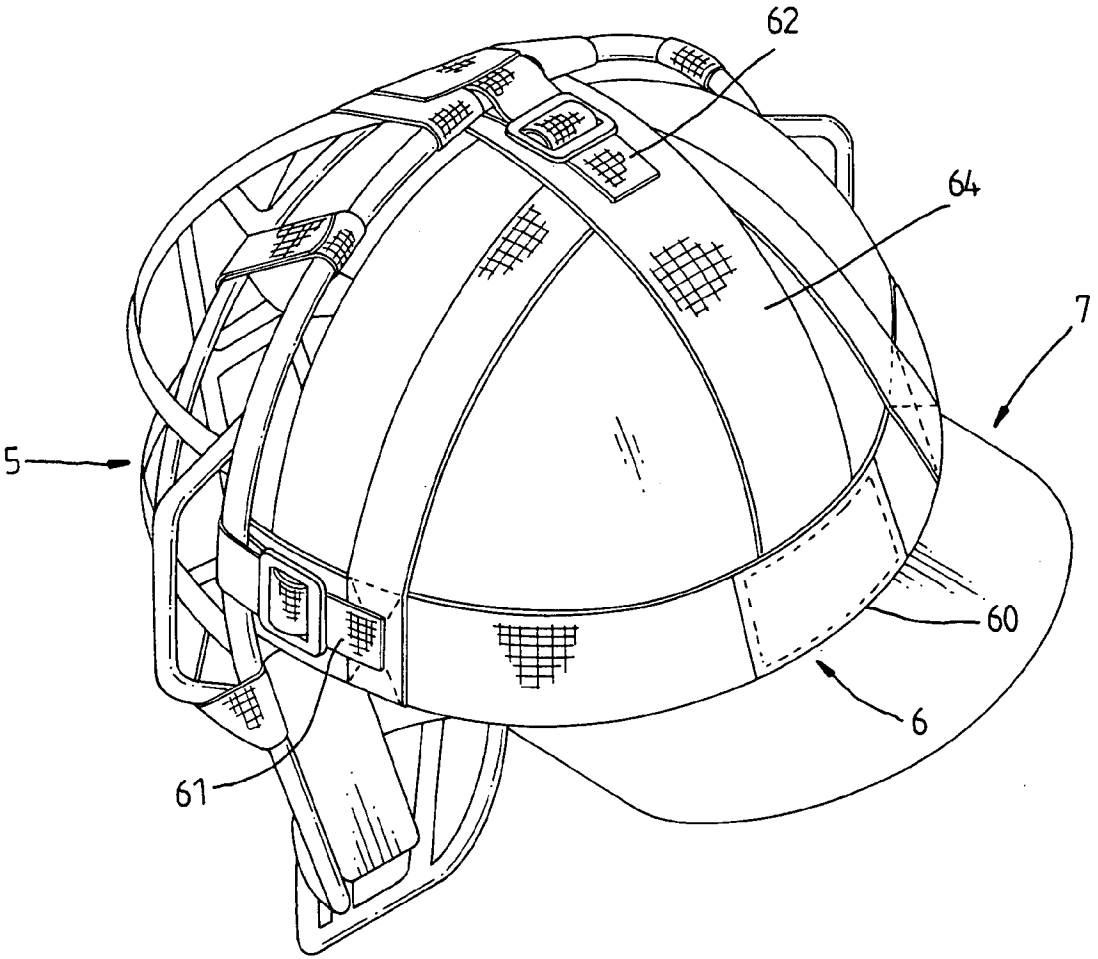
Fig. 3 PRIOR ART
FIG. 3 shows the prior art facemask attached to the catcher's helmet.
Figure 4:
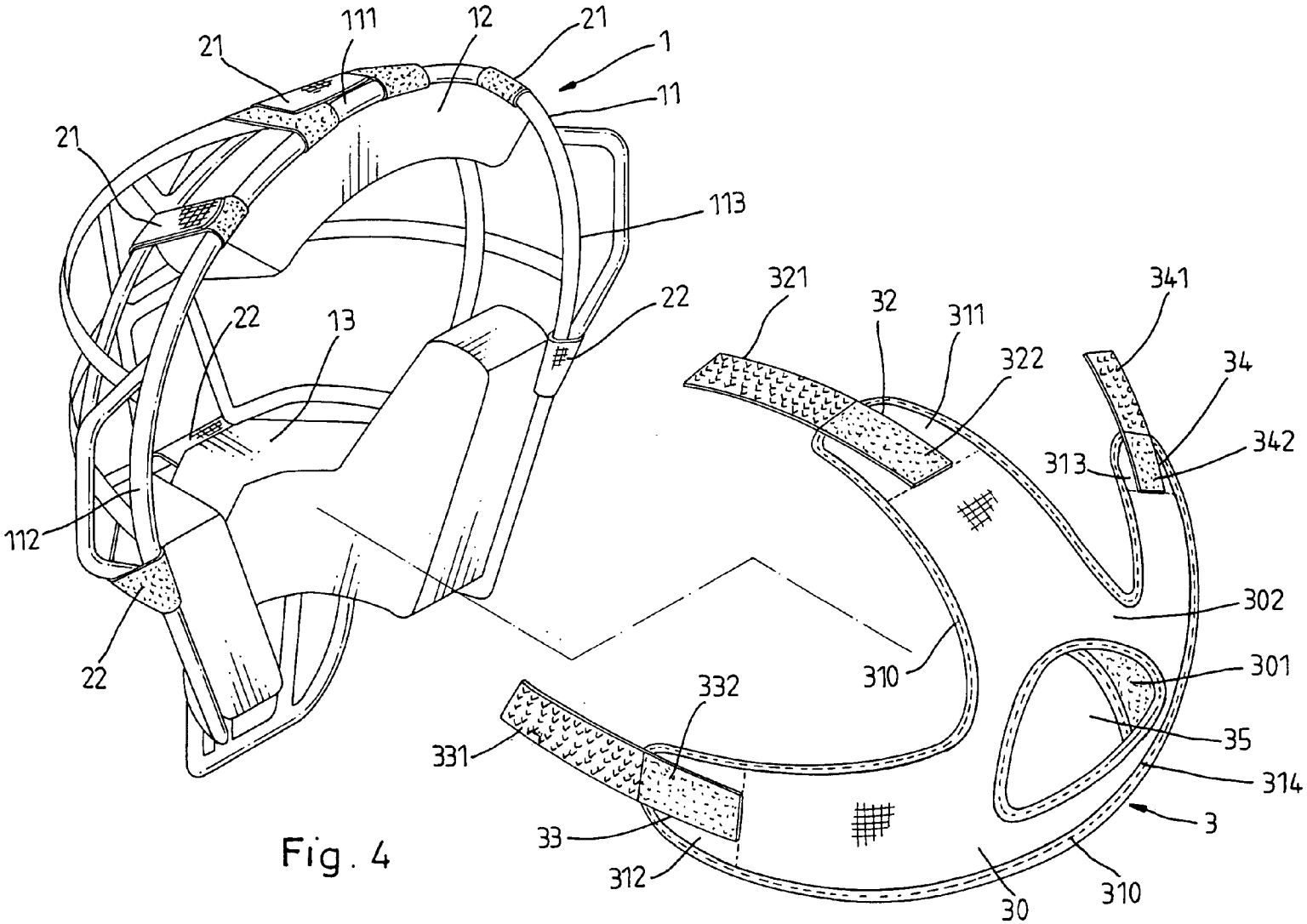
FIG. 4 is an exploded view of a facemask constructed according to the present invention.
Figure 5:
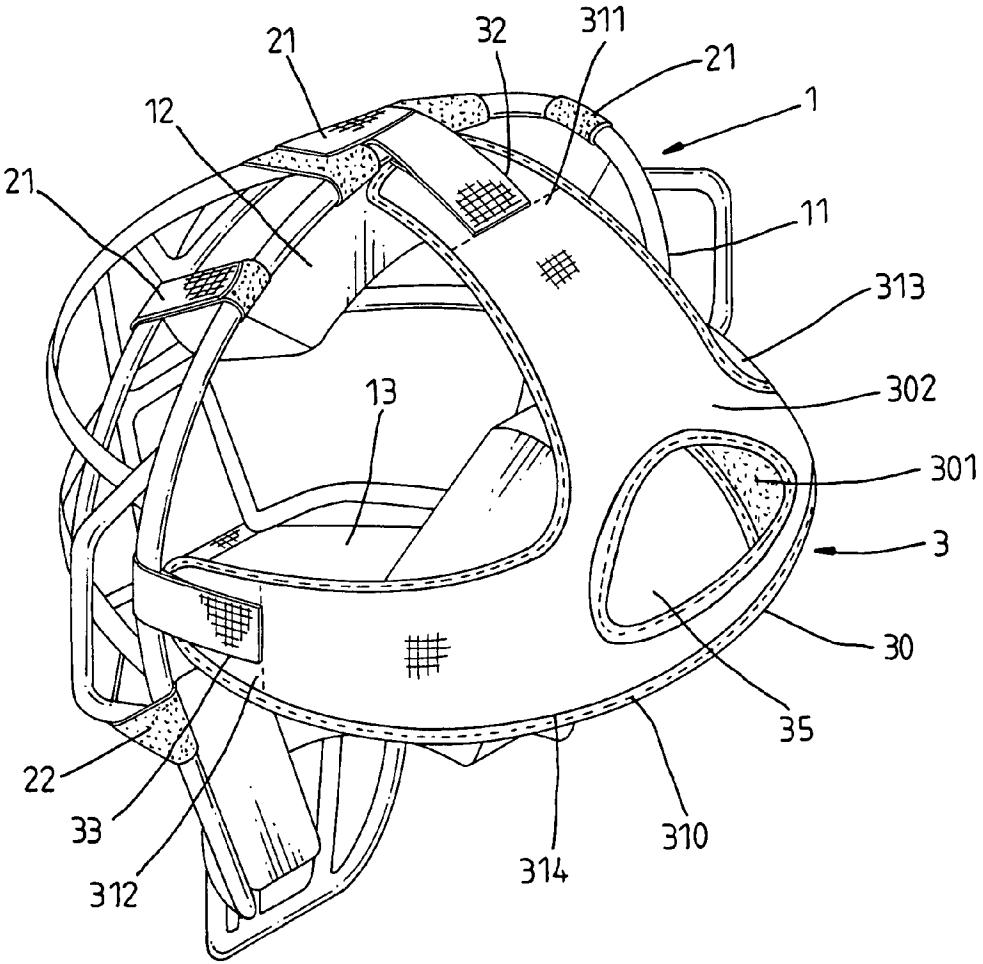
FIG. 5 is a perspective assembly view of the facemask shown in FIG. 4.
Figure 6:
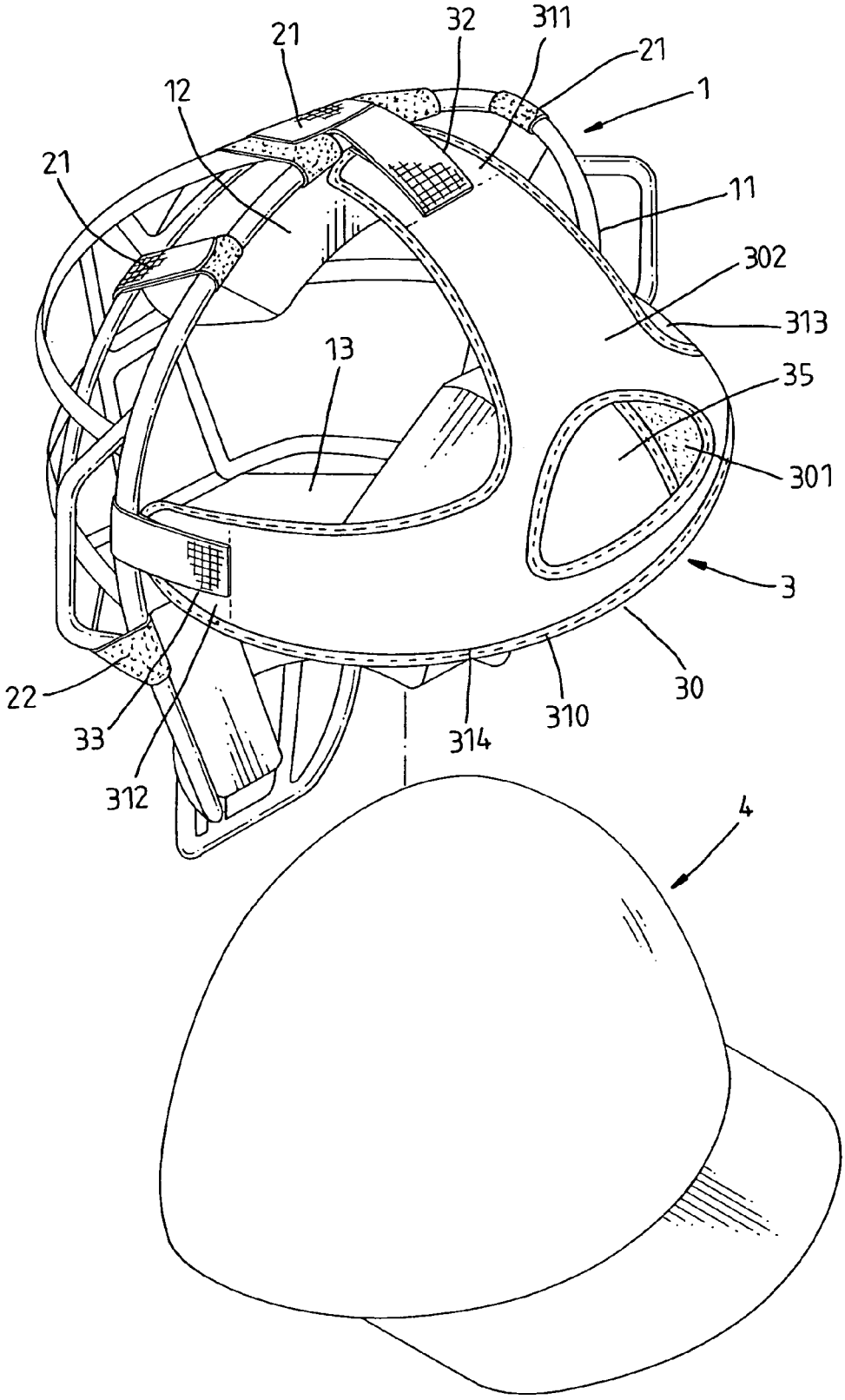
FIG. 6 is an exploded view of the facemask and the catcher's helmet according to the present invention.
Figure 7:
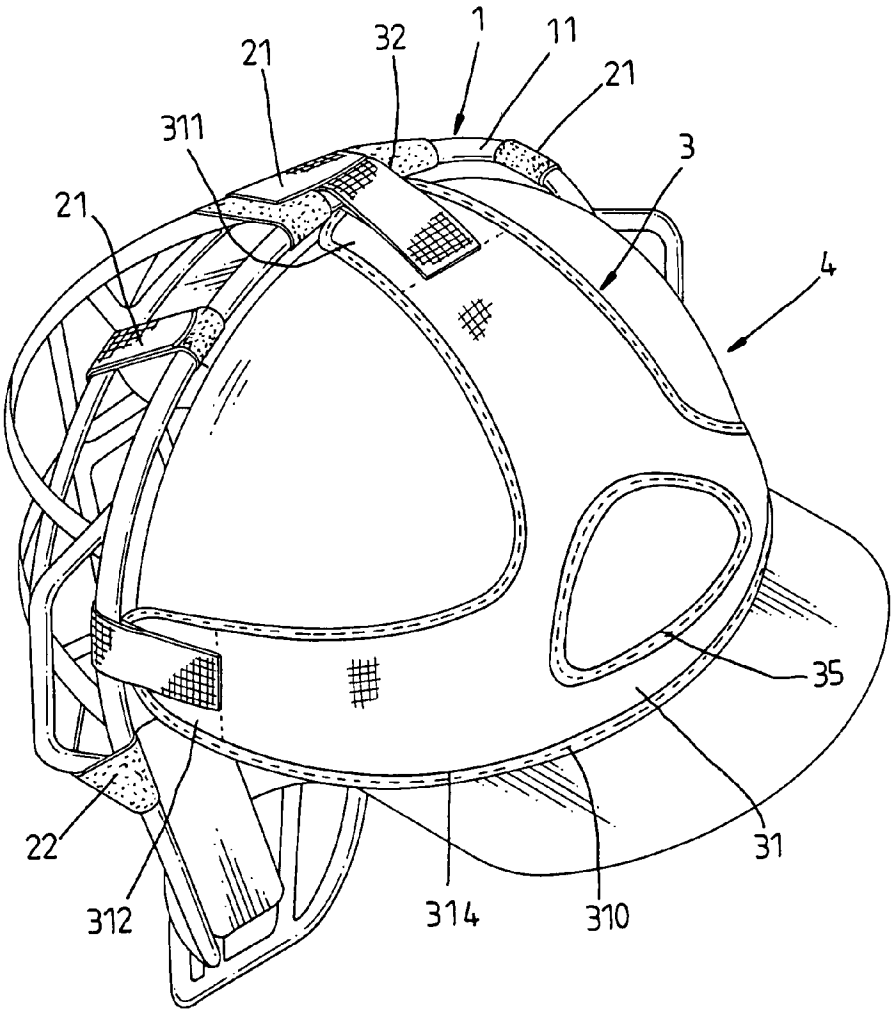
FIG. 7 shows the facemask attached to the catcher's helmet according to the present invention.
Figure 8:
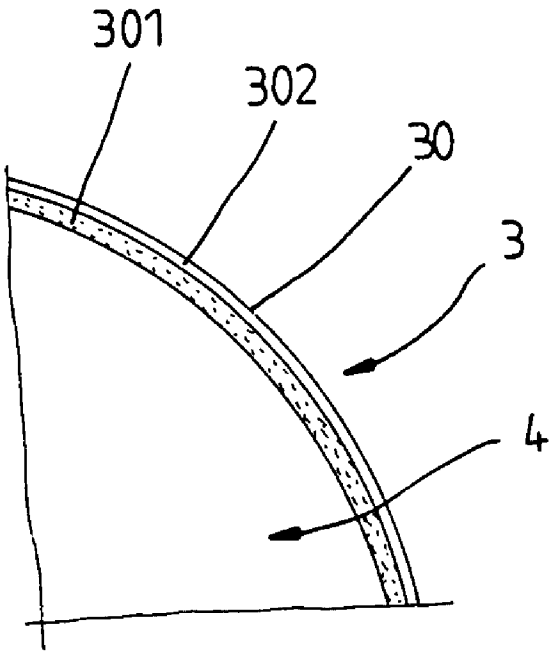
FIG. 8 is a sectional view in an enlarged scale of a part of FIG. 7.
Figure 9:
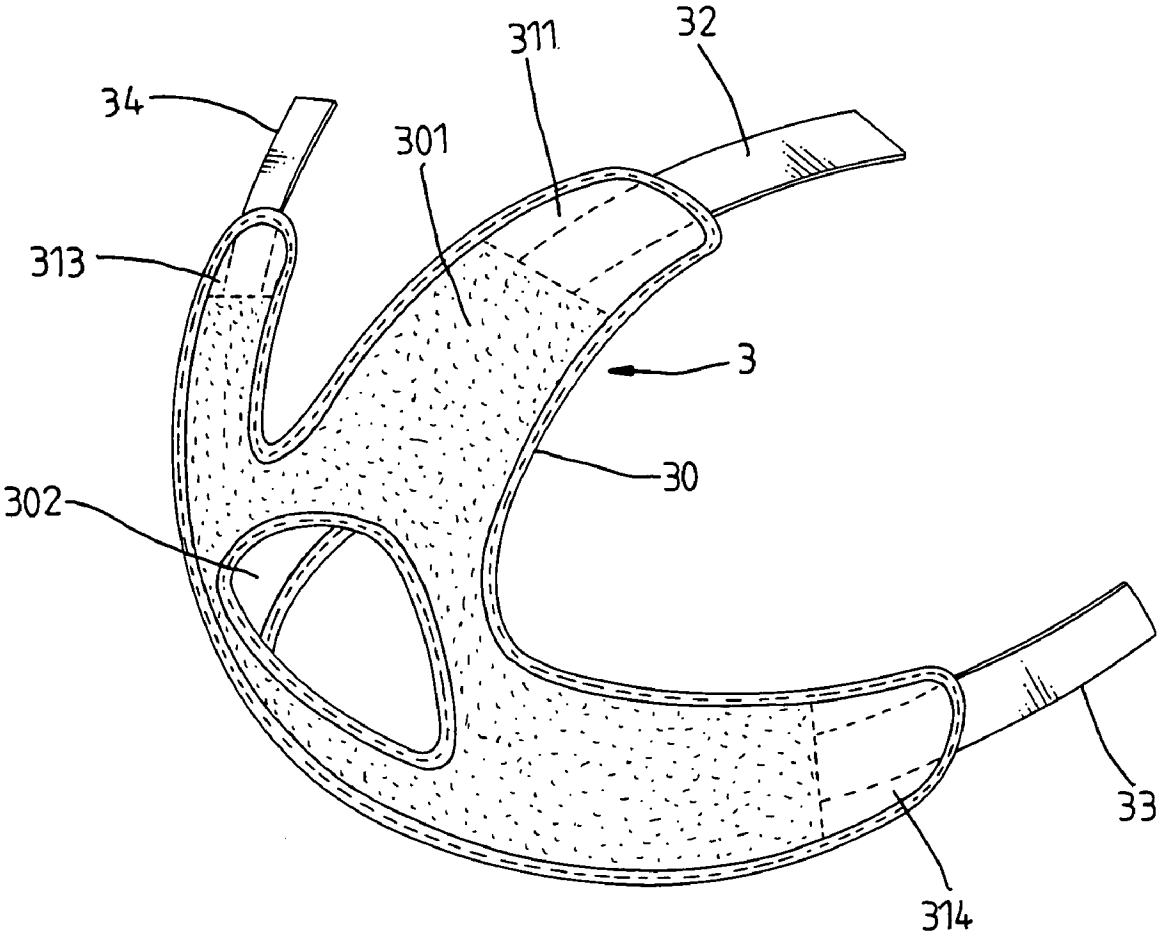
FIG. 9 is a perspective view of the facemask harness according to the present invention.

Referring to FIGS. 4~9, a facemask 1 is shown comprising a cage 11, an upper padding 12 fastened to the top side of the cage 11 by hook and loop materials 21, a lower padding 13 fastened to the bottom side of the cage 11 by hook and loop materials 22, and a facemask harness 3 adapted to secure the facemask 1 to the user's head. The facemask harness 3 comprises a body 30, a top strap 32 extended from the top side of the body 30 on the middle and fastened to a top middle part 111 of the cage 11, and two opposite side straps 33 and 34 respectively extended from two opposite lateral sides of the body 30 and respectively fastened to two opposite lateral sides 112 and 113 of the cage 11.

The body 30 is formed of an inner foam rubber layer 301 and an outer elastic fabric layer 302 adhered to the inner foam rubber layer 301. The body 30 is a substantially triangular member having a top side 311 stitched to the top strap 32, and two opposite lateral sides 312 and 313 respectively stitched to the side straps 33 and 34. After fastening of the facemask 1 to the user's head, the inner foam rubber layer 301 of the body 30 is maintained in contact with the user's helmet 4 (see FIGS. 6~8), preventing displacement of the facemask harness 3.

The facemask harness 3 further comprises a piping 314 formed of an elastic fabric and fastened to the border edge of the body 30 with a stitch line 310. The facemask harness 3 can include a center opening 35 located in a center.

Further, the top and side straps 32;33;34 each are provided with a respective tape of hook material 321;331;341 and a respective tape of loop material 322;332;342 for detachably fastening to the cage 11.

As indicated above, the body 30 of the facemask harness 3 is formed of an inner foam rubber layer 301 and an outer elastic fabric layer 302 adhered to the inner foam rubber layer 301, therefore the facemask harness 3 gives a comfortable wearing. Further, because the inner form rubber layer 301 is maintained in close contact with the user's helmet after fastening of the facemask 1 to the user's head, the facemask harness 3 does not slip, holding the facemask 1 positively in position.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A facemask harness for a facemask comprising:

a body having a top protrusion and two side protrusions extending outwardly in different directions from a center portion having a center opening, the top protrusion having a top strap connected to a top of the facemask, each of the two side protrusions having a side strap connected to one of two opposing sides of the facemask, wherein the body includes an inner foam layer connected to an outer elastic fabric layer.

2. The facemask harness according to claim 1, further comprising a piping formed from an elastic fabric fastened to an peripheral edge of the body with a stitching line.

3. The facemask harness according to claim 1, wherein each top strap and each side strap having a portion of a hook material and a portion of a loop material selectively engaging the hook material.

* * * * *